United States Patent [19]

Akasu

[11] Patent Number: 4,586,474

[45] Date of Patent: May 6, 1986

[54] KNOCK SUPPRESSION APPARATUS FOR INTERNAL COMBUSTION ENGINE

[75] Inventor: Masahira Akasu, Hyogo, Japan

[73] Assignee: Mitsubishi Denki Kabushiki Kaisha, Tokyo, Japan

[21] Appl. No.: 616,233

[22] Filed: Jun. 1, 1984

[30] Foreign Application Priority Data

Jun. 3, 1983 [JP] Japan ..... 58-99680
Jun. 3, 1983 [JP] Japan ..... 58-99681

[51] Int. Cl.[4] ..... F02P 5/15

[52] U.S. Cl. ..... 123/425; 123/421; 123/424; 123/435

[58] Field of Search ..... 123/425, 435, 416, 417, 123/480, 486, 421, 424, 491

[56] References Cited

U.S. PATENT DOCUMENTS 4,276,861 7/1981 Kearney et al. ..... 123/425
4,320,729 3/1982 Sawada et al. ..... 123/425
4,376,429 3/1983 Youngblood ..... 123/425
4,377,999 3/1983 Komurasaki et al. ..... 123/424
4,442,812 4/1984 Mizuno et al. ..... 123/424
4,458,646 7/1984 Suzuki et al. ..... 123/425
4,466,405 8/1984 Hattori et al. ..... 123/425
4,466,410 8/1984 Sakakibara et al. ..... 123/480

*Primary Examiner*—Andrew M. Dolinar
*Attorney, Agent, or Firm*—Bernard, Rothwell & Brown

[57] ABSTRACT

An apparatus for suppressing knock in an engine by first detecting the knock and sequentially renewing a control quantity, which is fed to means for controlling the running mode of the engine, in the direction of knock suppression until the knock detection output becomes nonexistent. The apparatus is equipped with means capable of prohibiting renewal of the control quantity when the engine is in any transient running state such as a stage immediately after its start, thereby preventing unstable running of the engine.

6 Claims, 4 Drawing Figures

KNOCK SUPPRESSION APPARATUS FOR INTERNAL COMBUSTION ENGINE

BACKGROUND OF THE INVENTION

1. Field of the Invention

The present invention relates to an apparatus for suppressing knock induced in an internal combustion engine by detecting such knock and controlling at least one of the performance characteristics of the engine.

2. Description of the Prior Art

Generally, induction of knocking is dependent on the performance characteristics of an engine including various factors such as ignition timing, air-to-fuel ratio, temperature and humidity of suction air, temperature of combustion chamber and so forth. Out of the above factors, ignition timing and air-to-fuel ratio are controllable with relative facility and low cost, so that each of them is employable as effective means in a feedback control system for knock suppression. Particularly the ignition timing control is utilized practically in many knock suppression apparatus known heretofore. In the conventional apparatus of such type based on the technique of ignition timing control, it is customary to execute a feedback control action in such a manner that the ignition timing is delayed from a preset reference point by a fixed angle upon induction of knocking or by a proper angle in conformity with the knocking intensity and, in case no knock is existent, the angular delay is reduced with a considerably great time constant (e.g. 0.5°/sec) to adjust the ignition timing eventually to the knock threshold point.

Although induction of knocking is dependent on a variety of factors as mentioned above, those concerned with natural phenomena such as temperature and humidity of suction air are in a relatively long variation cycle with respect to the lapse of time like a day or a season. Therefore, generation of knocking derived from any change in such factors also has a long variation cycle. In other words, knocks induced within a short period of time in one engine running mode are substantially the same, and there exists almost no difference among them with respect to the induction frequency or the average intensity. That is, the control quantities required for suppressing the knocks induced in one running mode are substantially the same within a short period of time. Therefore, in one running mode of an engine prescribed by particular running parameters, the control quantity stored previously is usable as a value for the present stage and, since the ignition-timing correction range may be narrow with regard to generation of slight-intensity knocking during the control action, high-precision knock suppression is achievable with a remarkably rapid response by executing sequential correction control in response to a knock detection signal at each time of the generation. Moreover, for any change occurring in the aforementioned long-cycle factor, the stored control quantity may be altered slowly to carry out the desired correction.

SUMMARY OF THE INVENTION

It is an object of the present invention to provide an improved knock suppression apparatus designed for use in an internal combustion engine and capable of preventing erroneous renewal of the average control quantity for each engine running mode by a knocking signal obtained in a transient running state of the engine, thereby achieving satisfactory knock suppression effect with accuracy in any engine running mode posterior to a warming-up stage.

Fundamentally, the knock suppression apparatus according to this invention comprises means for detecting induction of knocking in an engine; means for detecting a load state of the engine; means for detecting a rotational speed of the engine; means for detecting a transient running state of the engine; memory means capable of storing corrective control values conforming to individual engine running modes each represented by a combination of the load state and the rotational speed of the engine and, in response to input information of one running mode obtained from the load detecting means and the speed detecting means, outputting the corrective control value corresponding to the information received; means for correcting the control value which controls at least one of the operating characteristic values of the engine by using the value read out from the memory means and the output of the knock detecting means; renewal control means for altering, during the action of the knock detecting means, the corrective control value stored in the memory means to a new value in the direction of knock suppression and, in the absence of knock, altering the said corrective control value in the reverse direction; and means for prohibiting the action of the renewal control means during the action of the means which detects the transient running state of the engine.

The transient running state of the engine includes an unstable stage of rotation of the engine immediately after its start. And the present invention aims to prevent any unstable operation of the engine that results from execution of knock suppression in such transient running state of the engine.

DETAILED DESCRIPTION OF THE PREFERRED EMBODIMENTS

Figure 1:
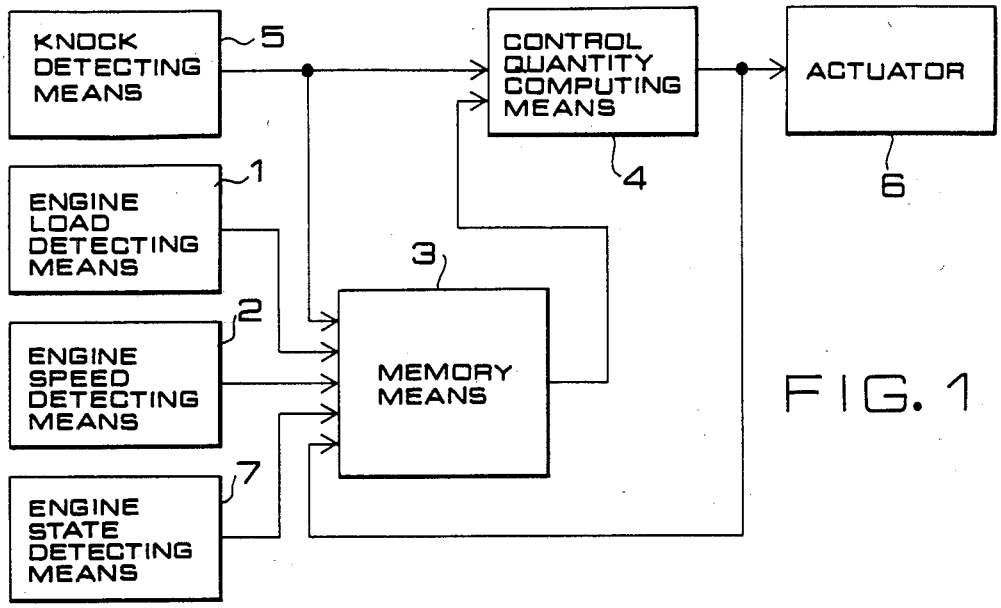
FIG. 1 is a block diagram showing the principle of the present invention.

Hereinafter an exemplary embodiment of the present invention will be described with reference to the accompanying drawings. The block diagram of FIG. 1 shows the fundamental constitution of the embodiment, wherein one of control quantities stored previously in individual areas of memory means 3 is read out in accordance with the load state of the engine detected by load detecting means 1 and also in accordance with the rotational speed of the engine detected by speed detecting means 2. The quantity thus read out is fed to control quantity computing means 4, which then calculates a knock-suppression control quantity on the basis of the value received from the memory means 3 and a knocking signal obtained from knock detecting means 5 and subsequently controls an actuator 6 according to the result of such calculation. When the running mode of the engine satisfies predetermined condition for discrimination, the control quantity stored in the memory means 3 is increased or decreased to be renewed in accordance with the presence or absence of the output signal of the knock detecting means 5. However, such renewal is prohibited when no output is obtained from engine-state detecting means 7.

Figure 2:
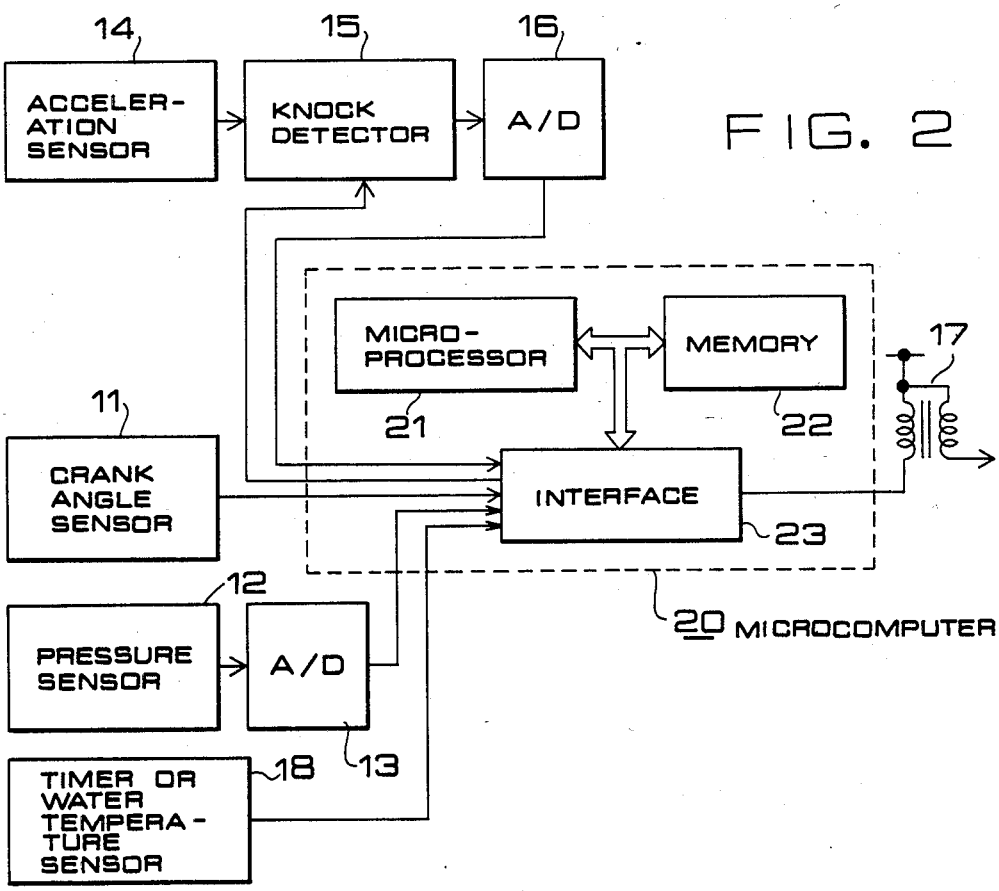
FIG. 2 is a block diagram of an exemplary knock suppression apparatus embodying the invention for use in an internal combustion engine.

FIG. 2 is a concrete block diagram of an exemplary apparatus embodying the present invention. As mentioned previously, there are a variety of factors relative to induction of knocking, and suppression thereof is achievable by controlling any of such factors. This embodiment will be described below with regard to a case of executing ignition timing control which is utilized most frequently in practical application. In FIG. 2, there are shown a crank angle sensor 11 for generating a reference crank angle signal in accordance with the rotation of an engine; a pressure sensor 12 for detecting a suction pipe pressure in the engine and producing a pressure signal proportional to the detected pressure; a first A/D converter 13 for digitizing the output signal of the pressure sensor 12 in accordance with its level; an acceleration sensor 14 attached to the engine and serving to detect the acceleration of the engine vibration; a knock detector 15 for discriminating from the output of the acceleration sensor 14 the knocking component generated due to knocking of the engine and producing a knocking signal of a level proportional to the intensity of the knocking; a second A/D converter 16 for digitizing the output signal of the knock detector 15; an engine-state detecting means 18 which, in this embodiment, is a timer for measuring the lapse of a time after an engine start point; and a microcomputer 20 principally comprising a microprocessor 21, a memory 22 and an interface 23 which processes input and output signals. Further shown is a ignition coil 17 controlled by the microcomputer 20.

The operation of the above embodiment having such constitution will now be described below. The crank angle sensor 11 detects the rotational angular position of the engine at a rate of once per ignition cycle during the engine rotation and produces an output pulse representing the reference crank angle, which is then fed to the interface 23 in the microcomputer 20. The pressure sensor 12 detects the suction pipe pressure in the engine and produces a pressure signal of a level corresponding to the detected pressure. Since the suction pipe pressure in the engine varies sharply in conformity with the engine load state, it is possible to find such load state from the level of the pressure signal obtained through detection of the suction pipe pressure. The pressure signal produced from the sensor 12 is digitized by the first A/D converter 13 and then is fed to the interface 23. Meanwhile, the acceleration sensor 14 is attached to the engine to detect the engine vibration continuously. The detection output of the sensor 14 includes a noise signal representative of mechanical noise resulting from the engine operation and also a knocking component resulting from the vibration caused by knocks. The knock detector 15 discriminates the knocking component from the detection output of the acceleration sensor 14 and produces a knocking signal of a level proportional to the knocking intensity. The knocking signal thus obtained is digitized by the second A/D converter 16 and then is fed to the interface 23. The knock detector 15 is reset by the interface 23 in response to a command from the microprocessor 21 and is thereby initialized for detection of knocking.

The memory 22 in the microcomputer 20 includes ROM and RAM. The ROM has an angular advance map to store, in addresses predetermined correspondingly to the rotational speeds and load states of the engine, reference control values for setting reference advance angles for ignition in individual running modes of the engine; and the RAM has a learning map to store, in addresses predetermined correspondingly to the rotational speeds and load states of the engine, corrective control values calculated according to the output of the knock detector 15 in individual running modes of the engine. The microcomputer 20 establishes an optimal ignition timing by computing the knock-suppression control quantity on the basis of the information obtained from the aforesaid crank angle sensor 11, pressure sensor 12 and acceleration sensor 14, and ignites the engine by interrupting energization of the ignition coil 17 at the ignition timing thus established. The microcomputer 20 further functions to check the output value of the timer 18 which keeps measuring the time posterior to the engine start point, and ascertains whether a predetermined time period has elapsed or not. And after the lapse of the predetermined time period, the average control quantity is renewed if the running mode of the engine satisfies the following two conditions.

Condition 1: The engine speed variation from the renewal start point is less than 50 rpm.

Condition 2: The engine load variation from the renewal start point is less than 5%.

If knocking is induced in such running state that the above conditions 1 and 2 are satisfied over 100 ignition cycles in succession and then sequential correction is executed for knock suppression, the sequential correction quantity is added to the above average control quantity to obtain a renewed average control quantity. In case the sequential correction quantity is zero or no knock is induced at all during this period, one unitary quantity is subtracted from the average control quantity to obtain a renewed average control quantity, which is subsequently stored in the learning map area corresponding to the present engine running mode. After such renewal of the average control quantity for knock suppression, a sequential control action is performed on the basis of the quantity thus renewed. That is, renewal of the average control quantity is so carried out as to minimize the sequential correction, thereby executing ignition at an optimal timing.

Supposing now that one engine running mode has transferred to another, the average control quantity stored in the learning map is not renewed in the transient state of the engine running mode according to the aforesaid conditions 1 and 2. Consequently, the sequential correction value established due to the knocking induced during transition of the engine running mode is not used for renewal of the average control quantity, thereby preventing storage of insignificant information (which does not represent the running mode at that moment). Furthermore, for knock suppression control during and after a change of the engine running mode, the stored average control quantity is read out from the learning map area corresponding to the running mode at that moment, and sequential correction for knock suppression is started on the basis of the average control quantity thus read out. That is, differing from the operation of the conventional apparatus, control is not commenced from the knock-suppression control quantity selected anterior to a change of the running mode, and it is possible to immediately assume a desired control state relative to the average control value already obtained, whereby remarkable improvement is attainable in the response characteristic for knock suppression control. In general, knocking is not readily induced when the engine is cold since its combustion chamber is at a low temperature. Accordingly, if renewal of the average control quantity is carried out in such condition, the quantity is altered in the direction to induce knocking and becomes insufficient after the stage of warming up the engine, hence bringing about the possibility of knocking as a result. In this embodiment, therefore, the running time period from the engine start point is measured so that renewal of the average control quantity is not executed until termination of warming up the engine. And after complete warming up posterior to the lapse of a predetermined time period, the microcomputer 20 performs renewal of the average control quantity. Consequently, such renewal is executed always in a normal running mode of the engine, and there exists no possibility of receiving any knocking information relative to the transient running state of the engine during the warming-up stage thereof, hence enabling accurate knock suppression control. Meanwhile, knock suppression in the transient state during the warming-up stage is carried out by sequential correction alone.

Figure 3:
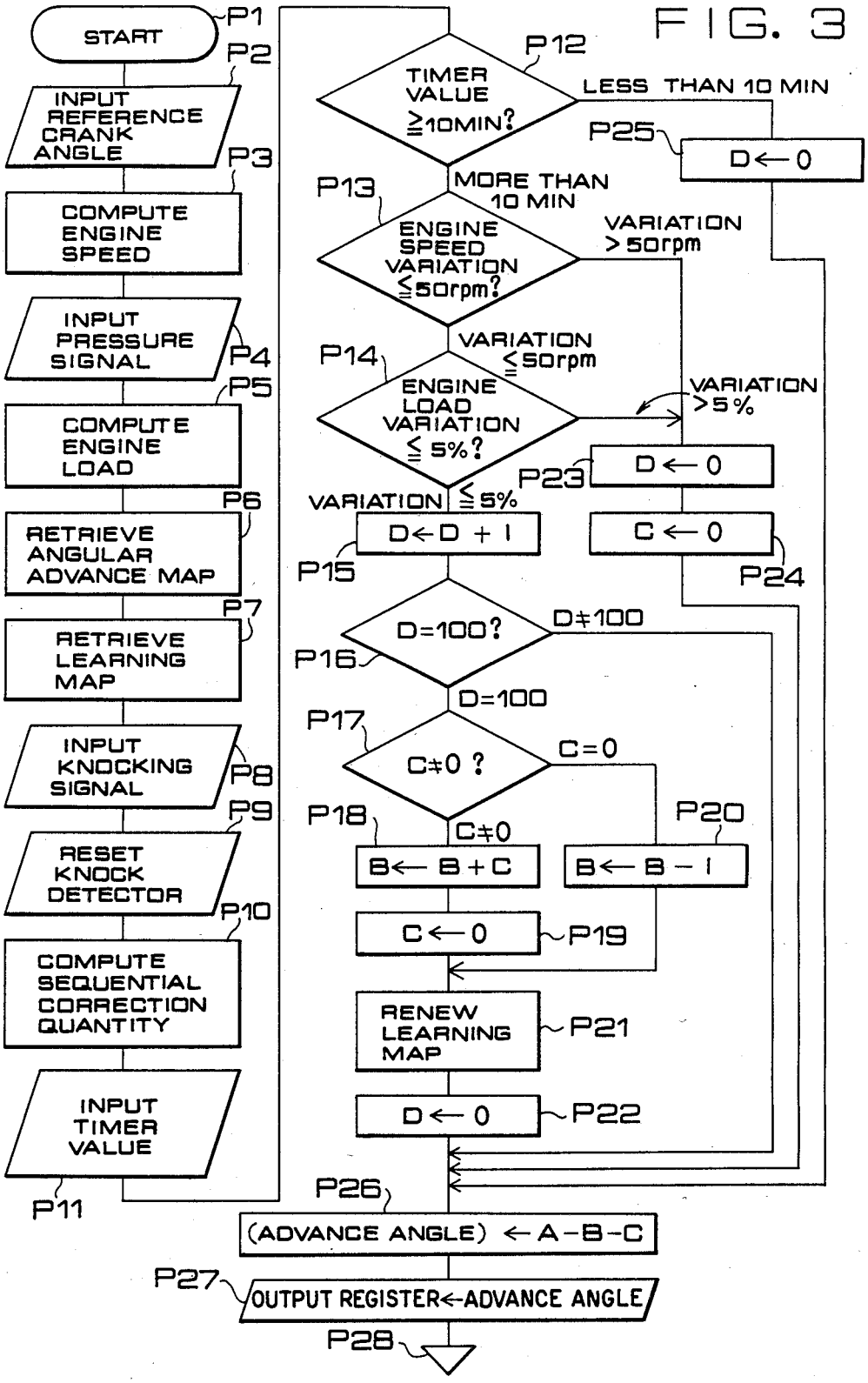
FIG. 3 is a flowchart representing the operation of the apparatus shown in FIG. 2.

FIG. 3 shows a flowchart for performing the above-described control action, wherein P1 through P28 denote a sequence of individual steps. Control computation is executed at a rate of, e.g. once per ignition cycle in response to each of input reference crank angle pulses. First, a reference crank angle pulse is inputted in step P2, and the period from the preceding reference crank angle pulse is converted into a rotational speed of the engine in step P3. A pressure signal is inputted in step P4, and a load state of the engine is calculated in step P5. In the next step P6, a preset advance angle corresponding to a combination of the rotational speed and the load state of the engine calculated respectively in steps P3 and P5 is retrieved from the angular advance map and then is stored in a register A. In step P7, as in the preceding step P6, an average control quantity for knock suppression corresponding to a combination of the rotational speed and the load state is retrieved from the learning map and then is stored in a register B. Subsequently a knock signal is inputted in step P8, and a signal for resetting the knock detector 15 is produced in step P9, so as to be ready for detecting induction of next knocking. In step P10, a control correction quantity corresponding to the level of the knock signal inputted in step P8 is calculated and added to the preceding sequential correction quantity already stored in a register C, and the composite signal is stored therein again. Subsequently, the content of the timer is inputted in step P11, and a check is executed in step P12 to ascertain whether a time of 10 minutes or more has elapsed from the engine start point. In case the content of the timer is less than 10 minutes, the value in a register D is cleared to zero in step P25, and the process jumps to step P26 without renewal of the average control quantity. The register D serves to count the number of ignitions to determine the renewal time for the average control quantity. When the content of the timer exceeds 10 minutes with complete warming-up of the engine, a check is executed in steps P13 and P14 to ascertain whether the rotational speed variation is less than 50 rpm (condition 1) and the load variation is less than 5% (condition 2). And if the condition 1 or 2 is not satisfied, the value in the register D is cleared to zero in step P23, and the insignificant sequential correction quantity C relative to the previous running mode is also cleared to zero in step P24. Then the process jumps to step P26. If the conditions 1 and 2 are both satisfied, a numerical value 1 is added to the value stored in the register D in step P15, and the result is stored therein again. Subsequently in step P16, a check is executed to ascertain whether the value in the register D is 100 or not, i.e. whether 100 ignition cycles have passed or not while satisfying the conditions 1 and 2. In the case of $D \neq 100$ which is anterior to the renewal timing, the process jumps to P26. In another case of $D=100$, a check is executed in step P17 to ascertain whether the sequential correction quantity stored in the register C is zero or not. And if $C=0$, one unitary control quantity is subtracted in step P20 from the average control quantity retrieved in step P7 and stored temporarily in the register B, and the result is stored in the register B. If $C \neq 0$, the value in the register C is added in step P18 to the value in the register B, and the result is stored again in the register B. Subsequently in step P19, the sequential correction quantity stored in the register C is cleared to zero. In step P21, the value in the register B altered previously in step P18 or P20 is stored as a new average control quantity at a position corresponding to the present running mode in the learning map. The value in the register D is cleared to zero in step P22 so as to be ready for the next renewal of the learning map. In step P26, a desired advance angle for ignition is determined by computing the present advance angle retrieved from the angular advance map in step P6 and stored in the register A, the average control quantity stored in the register B (or the quantity processed and renewed in steps P15 through P22), and also the sequential correction quantity stored in the register C. Subsequently in step P27, the advance angle for ignition is fed to an output register, and then the process proceeds in step 28 to the next control program. When the rotational angle of the engine has reached a position corresponding to the advance angle fed to the output register, the current energizing the ignition coil is interrupted by the interface 23 so that the engine is ignited.

If the engine is run continuously in the state satisfying the aforesaid conditions 1 and 2 and no knocking is induced over a time period of 100 ignition cycles, the average control quantity decreases by one unitary quantity as shown in step P20. Accordingly, during continuous running of the engine in such state, the average control quantity keeps decreasing at every lapse of 100 ignition cycles and finally reaches a negative value. That is, ignition is effected with a further angular advance from the point of the preset ignition advance angle (stored in the angular advance map). As mentioned previously, differing from the conventional knock suppression apparatus where such suppression is executed unidirectionally by controlling the angular delay from the preset advance-angle point for ignition, the present invention is capable of correcting the preset advance angle for ignition in both leading and lagging directions. Therefore, with regard to the data in the angular advance map where reference advance angles for ignition are stored, optimal values thereof established at the time of designing the engine are stored, and further an initial value 0 is stored in each area of the learning map where average control quantities are stored, so that knock suppression control in the initial stage is started with reference to the design values, and knocking caused due to nonuniformity of individual engines or seasonal changes can be suppressed by the average control quantities to eventually eliminate the necessity of presetting the estimated knock suppression control range that has been required heretofore in the conventional apparatus, hence enhancing the controlling capabilities in the initial stage.

It is desirable to control, out of various factors that induce knocking, an air-to-fuel ratio through regulation of fuel or an ignition timing as selected in the above embodiment, since many of the knock suppression apparatus in practical use adopt such air-to-fuel ratio control or ignition timing control and are advantageous to be implemented with facility and at low cost. In executing such air-to-fuel ratio control action, for example, a function similar to the aforementioned one is realizable by increasing the output amount of a fuel injection unit in accordance with a reference control signal corresponding to the knock signal.

The timer 18 employed as engine-state detecting means in the embodiment of FIG. 2 is replaceable with a water temperature sensor capable of detecting the temperature of cooling water in the engine. The output of the temperature sensor 18 is once converted into a digital signal by the A/D converter 19 and then is inputted to the microcomputer 20 as a signal representing the state of the engine.

Figure 4:
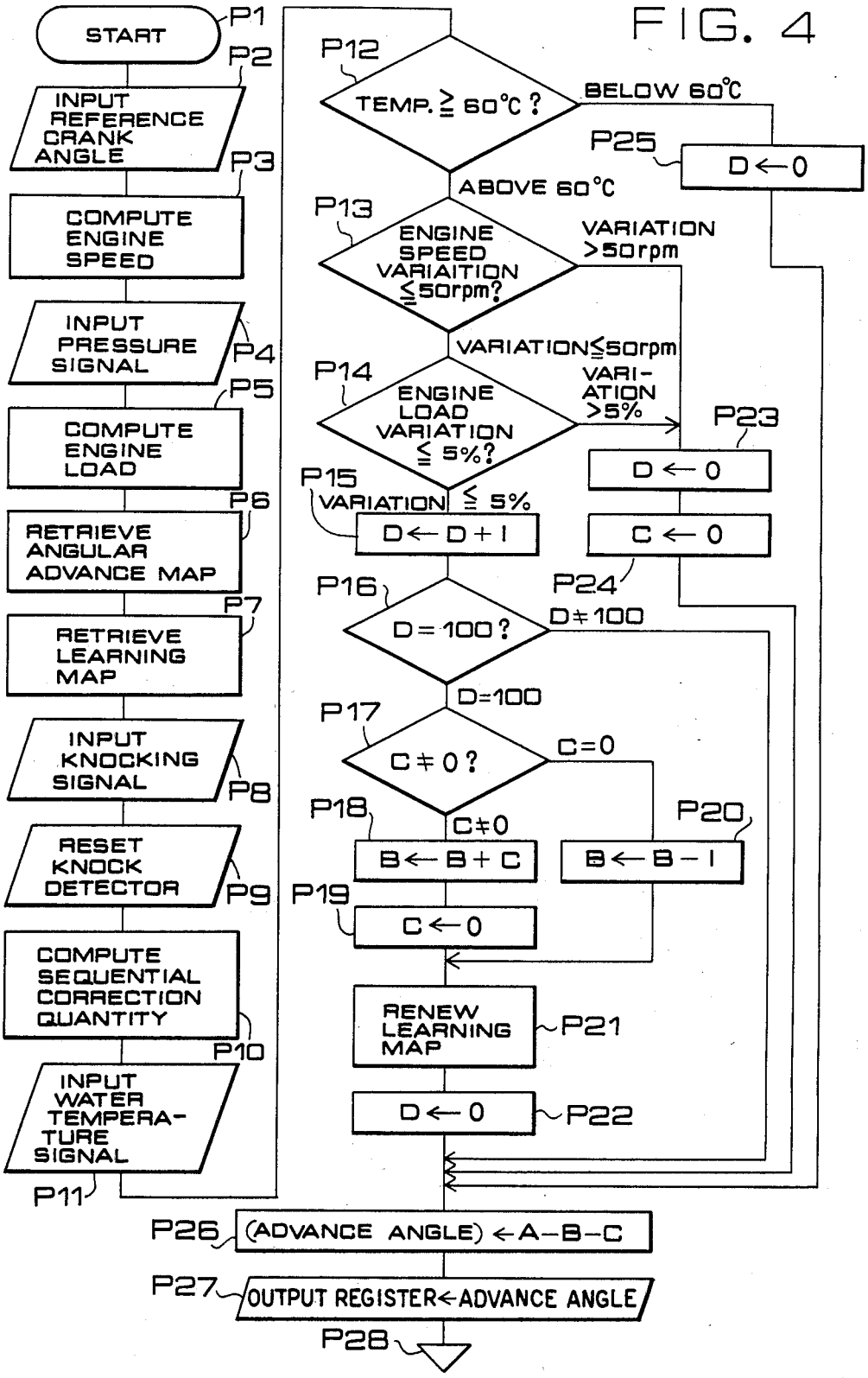
FIG. 4 is a flowchart representing the operation of another embodiment of the invention.

In another flowchart of FIG. 4 showing the operation of the knock suppression apparatus having such constitution, steps P1 through P10 are equal to those in the foregoing flowchart of FIG. 3. Posterior to the above steps, a water temperature signal from the sensor 18 is inputted in step 11, and a check is executed in step P12 to ascertain whether the cooling water temperature in the engine is above 60° C. or not, for example. In case the water temperature is below 60° C., the value in the register D is cleared to zero in step P25, and then the process proceeds to step P26 without renewal of the average control quantity. Meanwhile, if the water temperature is confirmed to be above 60° C., the stage of warming up the engine is considered to be over and, as already mentioned, renewal of the average control quantity is executed in steps P13 through P28.

In the above embodiment, the engine warming-up stage is regarded as one transient running state of the engine and renewal of the average control quantity for knock suppression is carried out in response to the output of the water temperature sensor 18. In such arrangement, the sensor 18 may be a switch turned on or off at a predetermined temperature, and a similar control action can be realized through detection of the warming-up stage by some other proper means. Furthermore, it is to be understood that the transient running state of the engine is not limited to such warming-up stage alone, and the same effect is achievable by detecting some other transient state and renewing the average control quantity in accordance with the detection output.

As described hereinabove, in a feedback control system for detecting knocks induced in an engine and generating a control signal in accordance with the detection output to suppress the knocks, the present invention has memory areas corresponding to the individual rotational speeds and load states of the engine, and average control quantities established for knock suppression in the individual running modes of the engine are stored in the memory areas respectively. And during the running of the engine, the average control quantity related to the running mode is read out from the memory area to control the knocking component. For any knock of a slight intensity generated during such control, a sequential correction quantity is added to the aforesaid average control quantity to carry out knock suppression control, thereby achieving satisfactory response in the knock suppression. In this manner, when sequential correction is executed for the induced knocking, the sequential correction quantity is added to the average control quantity at a predetermined cycle. Meanwhile, if no knocking is induced and the sequential correction quantity is zero, the average control quantity is reduced by a predetermined value and is stored in the corresponding memory area to renew the average control quantity previously stored, thereby ensuring adequate response to any long-period variation of the knock-inducing factors. Moreover, when there occurs a change in the engine running m9ode, it is possible to remove undesired influence of the insignificant knock-suppression control quantity for the stage anterior to and during such change, so that the time lag in knock suppression is eliminated eventually to attain remarkable improvement in the knock suppression response. Furthermore, another means may be provided to detect the running mode of the engine in addition to the aforesaid rotational speed, load state or induced knock and may also be used for detecting the transient running state of the engine to prohibit renewal of the average control quantity for knock suppression in such transient running state. Then the average control quantity is rendered renewable with accuracy to always ensure adequate knock suppression, hence achieving remarkably advantageous effects over the entire running modes of the engine.

What is claimed is:

1. A knock suppression apparatus for an internal combustion engine, comprising:

means for detecting knock induced in the engine;

means for detecting the load state of the engine;

means for detecting the rotational speed of the engine;

means for detecting the transient running state of the engine;

memory means for storing corrective control values corresponding to the individual running modes of the engine each represented by a combination of the load and the rotational speed of the engine and, in response to the input information from said load detecting means and said speed detecting means, outputting the corrective control value corresponding to said information;

means for correcting the control value which controls at least one of the operating characteristic values of said engine by using the value read out from said memory means and the output of said knock detecting means, said control value being so corrected at each ignition cycle;

renewal control means responsive to the output of said knock detecting means and renewing, in the direction of knock suppression, the corrective control value stored in said memory means or, in the absence of any knock detection output, renewing said stored corrective control value in the reverse direction, said renewal control means being arranged to effect renewal of said corrective control value only at intervals corresponding to a plurality of ignition cycles; and means for prohibiting the action of said renewal control means when a transient running state is detected by said means for detecting the transient running state of the engine.

2. The apparatus as defined in claim 1, wherein said knock detecting means comprises an acceleration sensor for detecting the acceleration of the engine vibration, and a knock detector for discriminating from the output of said acceleration sensor a signal component derived from knocking of the engine.

3. The apparatus as defined in claim 1, wherein said means for detecting the transient running state of the engine is a timer which is actuated at the start of the engine and, after the lapse of a predetermined time period, produces an output signal to indicate termination of the transient running state.

4. The apparatus as defined in claim 3, wherein said timer has a preset time period of ten minutes.

5. The apparatus as defined in claim 1, wherein said means for detecting the transient running state of the engine is a water temperature sensor which detects the temperature of cooling water in the engine and, upon arrival of the water temperature at a preset value, produces an output signal to indicate termination of the transient running state.

6. The apparatus as defined in claim 5, wherein said water temperature sensor has a preset value of about 60° C.

* * * * *